US006282717B1

(12) United States Patent
Ng

(10) Patent No.: US 6,282,717 B1
(45) Date of Patent: Sep. 4, 2001

(54) ONE SIZE FITS ALL T-SHIRT

(76) Inventor: Andrew Ng, 1/Floor, 84 Po Wah Yeun Yung Shue Wan Lamma Island (HK)

( * ) Notice: Subject to any disclaimer, the term of this patent is extended or adjusted under 35 U.S.C. 154(b) by 0 days.

(21) Appl. No.: 09/533,046

(22) Filed: Mar. 22, 2000

(51) Int. Cl.[7] ..... A41B 1/00
(52) U.S. Cl. ..... 2/70; 2/115
(58) Field of Search ..... 2/70, 110, 121, 2/122, 323, 326, 329, 333, 237, 269, 115, 77, 76; D2/720

(56) References Cited

U.S. PATENT DOCUMENTS

| | | | | |
|---|---|---|---|---|
| 251,805 | * | 1/1882 | Stevens . | |
| 253,256 | | 2/1882 | Barker . | |
| 256,747 | | 4/1882 | Shedaker . | |
| 280,444 | * | 7/1883 | Bush . | |
| 362,565 | * | 8/1887 | Yarwood . | |
| D. 396,339 | | 7/1998 | Ramsey | D2/720 |
| 459,106 | * | 9/1891 | Fifield . | |
| 646,356 | * | 3/1900 | Chaplain . | |
| 719,650 | * | 2/1903 | Davis . | |
| 728,025 | * | 5/1903 | Seidel . | |
| 818,351 | * | 4/1906 | Clark . | |
| 877,416 | | 1/1908 | Fanta . | |
| 879,685 | | 2/1908 | Siewers . | |
| 901,046 | | 10/1908 | Stiles . | |
| 1,010,679 | * | 12/1911 | Pandernacht . | |
| 1,060,329 | * | 4/1913 | Feldman . | |
| 1,062,467 | * | 5/1913 | Huntzinger . | |
| 1,233,156 | | 7/1917 | Zies . | |
| 1,489,046 | * | 4/1924 | Thompson . | |
| 2,405,368 | * | 8/1946 | Oresman | 2/74 |
| 2,470,031 | | 5/1949 | Harris | 2/76 |
| 2,470,678 | | 5/1949 | Auslender | 2/105 |
| 2,493,545 | * | 1/1950 | Muyleart | 2/70 |
| 2,507,463 | * | 5/1950 | Smith | 2/76 |
| 2,591,513 | | 4/1952 | Cormier | 2/74 |
| 2,653,323 | * | 9/1953 | Ganim | 2/42 |
| 2,685,740 | | 8/1954 | Augustin | 33/12 |
| 3,116,491 | * | 1/1964 | Previdi et al. | 2/106 |
| 3,789,429 | * | 2/1974 | Garcia | 2/79 |
| 4,494,248 | * | 1/1985 | Holder | 2/69 |
| 4,580,298 | * | 4/1986 | Tuisl | 2/237 |
| 4,683,595 | * | 8/1987 | Cash | 2/105 |
| 4,697,288 | * | 10/1987 | Palumbo | 2/269 |
| 5,088,116 | | 2/1992 | Gould | 2/82 |
| 5,170,505 | * | 12/1992 | Rohrer | 2/69 |
| 5,398,343 | | 3/1995 | Kuracina | 2/115 |
| 5,575,010 | * | 11/1996 | Chung | 2/227 |
| 5,628,064 | | 5/1997 | Chung | 2/70 |
| 5,720,044 | | 2/1998 | Robinson | 2/77 |
| 5,727,256 | | 3/1998 | Rudman | 2/115 |

* cited by examiner

*Primary Examiner*—John J. Calvert
*Assistant Examiner*—Alissa L. Hoey
(74) *Attorney, Agent, or Firm*—Brian S. Steinberger; Law Offices of Brian S. Steinberger

(57) ABSTRACT

An adjustable garment shirt for allowing different sized persons to be able to wear the shirt by allowing the wearer to be able to tighten and pull drawstrings together allowing multiple panel sections to cover different and varying sized bodies. Drawstring type laces criss-cross back and forth between rows of lace holes that are located on the edges of panels on the garment. The ends of the drawstrings can have hook and loop fastener ends that attach to different locations on hook and loop fastener rectangular patches located on the panels. The further along the fastener tie end is located on the rectangular patch, the closer the panels connect to one another. Extra flap materials can exist between the edges of the panels so that modesty of the wearer can be maintained.

18 Claims, 6 Drawing Sheets

ONE SIZE FITS ALL T-SHIRT

This invention relates to clothing, and in particular to a shirt that can be adapted to fit different body sizes having separate front and rear quarter panels that connect together by tie laces that pass through tie holes.

BACKGROUND AND PRIOR ART

Various garments have been proposed over the years that have sections for ventilation and for cooling. See for example, U.S. Pat. Nos. 5,720,044 to Robinson; 5,727,256 to Rudman; and 5,398,343 to Kuracina. However, these patents are restricted to fixed ventilation panels that can have removable sections. The patents do not allow for a single garment shirt to be easily used on different body sizes.

Other patents have been proposed over the years for garments that have removable sections. See for example, U.S. Pat. Nos. 5,088,116 to Gould; and 5,628,064 to Chung. However, these patents are limited to only allow for the removal of panel sections, such as removing a sleeve to make a long sleeve shirt into a short sleeve shirt. These patents do not allow for a single garment shirt to be easily used on different body sizes.

Other patents of interest include U.S. Pat. Nos. Des. 396,339 to Ramsey; 253,256 to Barker; 256,747 to Shedaker; 877,416 to Fanta; 879,685 to Siewers; 901,046 to Stiles 1,233,156 to Zies; 2,470,031 to Harris; 2,470,678 to Auslender; 2,591,513 to Cormier; and 2,685,740 to Augustin. Again, none of these patents allow for a single garment to be easily adapted to be used on different body sizes.

SUMMARY OF THE INVENTION

The first objective of the present invention is to provide a one size fits all garment shirt that can fit a range of people having different body sizes.

The second object of this invention is to provide a one size fits all garment shirt that allows the user to reveal parts of their body at expansion areas or cover the expansion areas.

The third object of this invention is to provide a one size fits all garment shirt that can be ventilated when needed.

The fourth object of this invention is to provide a one size fits all garment shirt that reduces manufacturer production costs, simplifies stock control, and eliminates the over production of certain sizes as compared to producing various size garment shirts for different body types.

The invention relates to high fashion summer clothing. A preferred embodiment comprises an upper body shirt with short sleeves having front and rear quarter panels of fabric that are connected together by tie strings passing through lace holes. The panels expand away from one another and are pulled toward one another by loosening and tightening the tie strings. The shirt can be quickly and easily converted from small sizes to large sizes and vice versa as needed. Thus, the same person can wear the shirt as they grow, as well as various persons having different body sizes. Between each of the panels, an extendible fabric can be lowered to cover the expansion joint area allowing modest individuals to not be revealed. The loose exposed ends of the tie strings can be attached to the body of the shirt by hook and loop fasteners (i.e. Velcro®), and the like.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
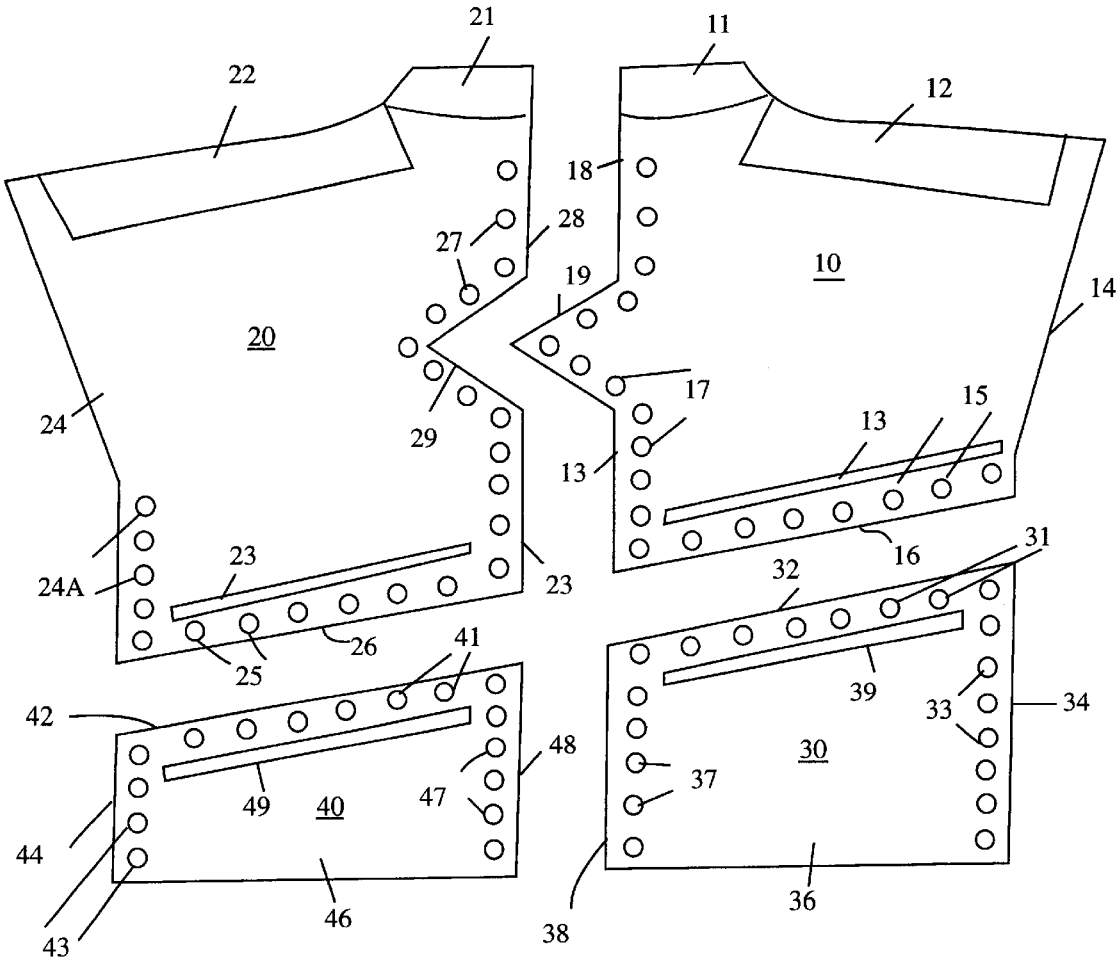
FIG. 1 shows the front view of a preferred embodiment of the invention of the garment shirt having panels separated from one another.
Figure 2:
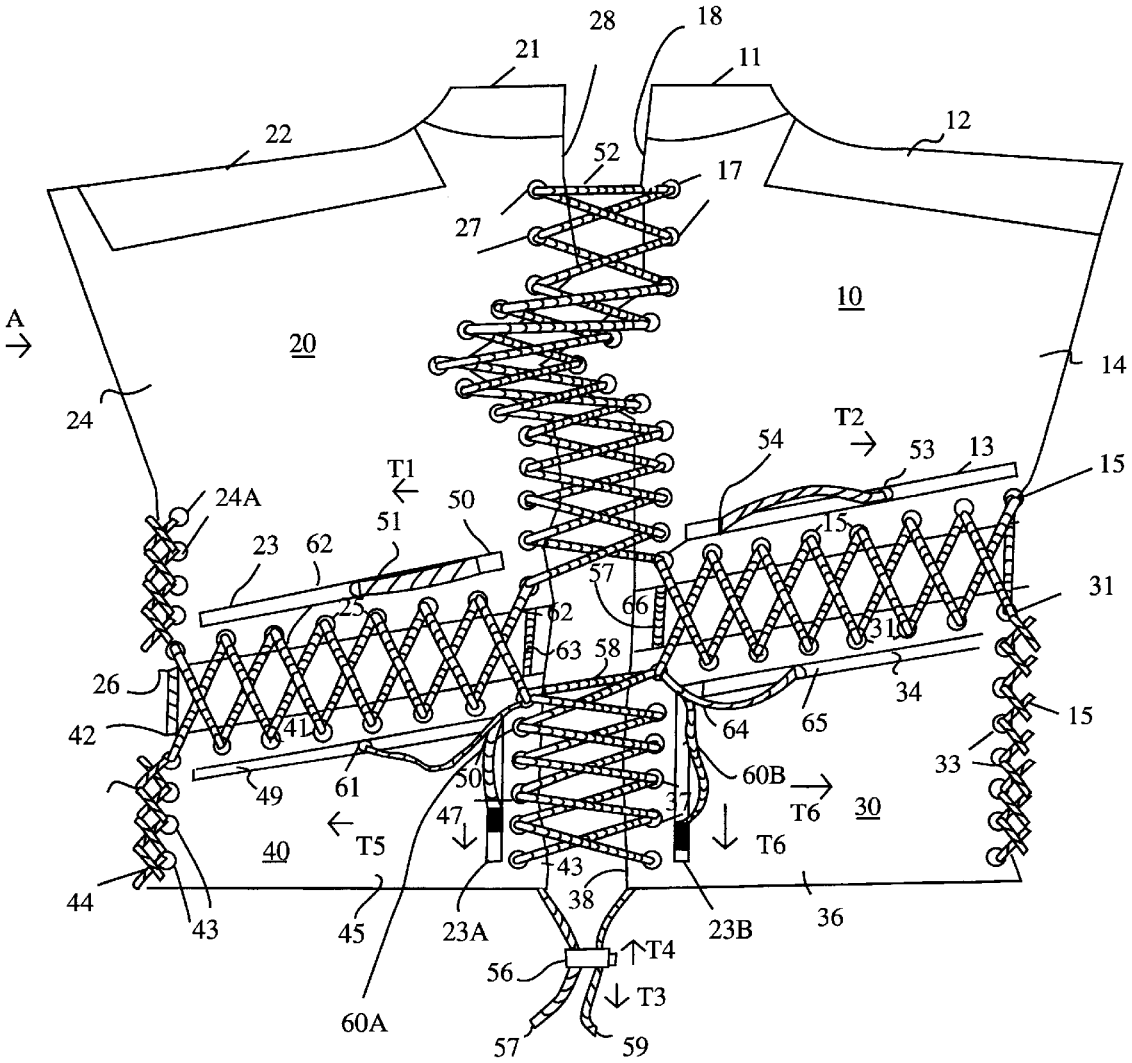
FIG. 2 is a front view of the shirt of FIG. 1 with lace strings and hook and loop fastener pads.

FIG. 1 shows the front view of a preferred embodiment of the invention of the garment shirt having panels separated from one another. FIG. 2 is a front view of the shirt of FIG. 1 with lace strings and hook and loop fastener pads. Referring to FIGS. 1–2, left front quarter panel 10 covers a front left breast portion of a wearer and has an upper end left shoulder cover 12, that covers the left shoulder of the wearer and is fixably or removably attached thereon by being sewn, hook and loop fasteners, and the like. A left collar band portion 11 is attached for fitting about the left neck portion of the wearer. One vertical side edge 14 can angle slightly inwardly running from the edge of the shoulder. The opposite vertical side edge 18 can run perpendicular to the shoulders of the wearer, and include a triangular shaped extended mid portion 19. Along the vertical side edges 18, 19 can be a row of lace holes 17. The bottom edge 16 can be substantially horizontal with a slight upwardly angled lower edge. Across the bottom edge 16 is a row of lace holes 15, and a tension adjustment strip 13 that can be a sewn on rectangular patch with exposed hook and loop fasteners.

Right front quarter panel 20 covers a front right breast portion of a wearer and has an upper end right shoulder cover 22, that covers the right shoulder of the wearer and is fixably or removably attached thereon by being sewn, hook and loop fasteners, and the like. A right collar band portion 21 is attached for fitting about the right neck portion of the wearer. One vertical side edge 24 can angle slightly inwardly running downward from the edge of the shoulder, with a bottom straight edge having a small row of lace holes 24A. The opposite vertical side edge 28 can run perpendicular to the shoulders of the wearer, and include an inwardly cut-out triangular mid portion 29. Along the vertical side edges 28, 29 can be a row of lace holes 27. The bottom edge 26 can be substantially horizontal with a slight upwardly angled lower edge. Across the bottom edge 26 is a row of lace holes 25, and a tension adjustment strip 23 that can be a sewn on rectangular patch with exposed hook and loop fasteners.

Lower left front panel 30 can include an upwardly sloped angled edge 32 having a row of lace holes 31, thereon and a rectangular hook and loop fastener patch 39 along the row of lace holes 31. Outer vertical edge 34 can also include a row of lace holes 33. An opposite inner vertical edge 38 can include a row lace holes 37. A bottom horizontal edge 36 can run between inner and outer vertical side edges 34, 38.

Lower right front panel 40 can include an upwardly sloped angled edge 42 having a row of lace holes 41, thereon and a rectangular hook and loop fastener patch 49 along the row of lace holes 41. Outer vertical edge 44 can also include a row of lace holes 43. An opposite inner vertical edge 48 can include a row lace holes 47. A bottom horizontal edge 46 can run between inner and outer vertical side edges 44, 48.

Referring to FIG. 2, inner side edge 18 of left panel 10 can be joined to inner side edge 28 of right panel 20 by a single tie lace 52 criss-crossing back and forth between rows of lace holes 17 and 27. Exposed end 51 of lace 52 can pass through a fixed loop 50 located on one end of rectangular patch 23. End 51 can include an end having hook and loop fasteners thereon for being removably fastened to various positions along hook and loop rectangular fastener patch 23. The further along tie end 51 is moved in the direction of arrow T1, the smaller the space exists between the side panel edges 18, 28. Likewise opposite exposed tie lace end 53 passes through a fixed loop 54 located on one end of rectangular patch 13. End 53 can include an end having hook and loop fasteners thereon for being removably fastened to various positions along hook and loop rectangular patch 13. The further along tie end 53 is moved in the direction of arrow T2, the smaller the space exists between side panel edges 18, 28.

Inner side edges 38 and 48 are joined by a single tie lace 58 having respective ends 57, 59 which pass through and criss-cross back and forth through rows of lace holes 37 and 47. A screwable tension clip 56 can be moved upward in the direction of arrow T4, while tie ends 57, 59 are moved downward in the direction of arrow T3. Moving the clip and tie ends in opposite directions allows for the space between inner side edges 38, 48 to be adjusted.

Referring to FIGS. 1–2, the bottom edge 26 of right upper panel 20 can be joined to upper edge 42 of lower right panel 40 by a single tie lace 62 having an end 61 which passes through and criss-crosses back and forth between rows of lace holes 25 and 41. Exposed end 61 of tie 62 can have a hook and loop fastener end which fastens onto hook and loop rectangular fastener patch 49. Moving end 61 through fixed loop 60 located on one end of patch 49 in the direction of arrow T5 adjusts the space between edges 26 and 42. The end of tie lace 63 is extended through the loop 60A and attached to hook and loop(Velcro) base 23A.

Referring to FIGS. 1–2, the bottom edge 16 of left upper panel 10 can be joined to upper edge 32 of lower left panel 30 by a single tie lace 66 having an end 65 which passes through and criss-crosses back and forth between rows of lace holes 15 and 31. Exposed end 65 of tie 66 can have a hook and loop fastener end which fastens onto hook and loop rectangular fastener patch 39. Moving end 65 through fixed loop 64 located on one end of patch 39 in the direction of arrow T6 adjusts the space between edges 26 and 42. The end of lace 67 is extended through the lower panel through loop 60B and attached to hook and loop base 23B.

Figure 3:
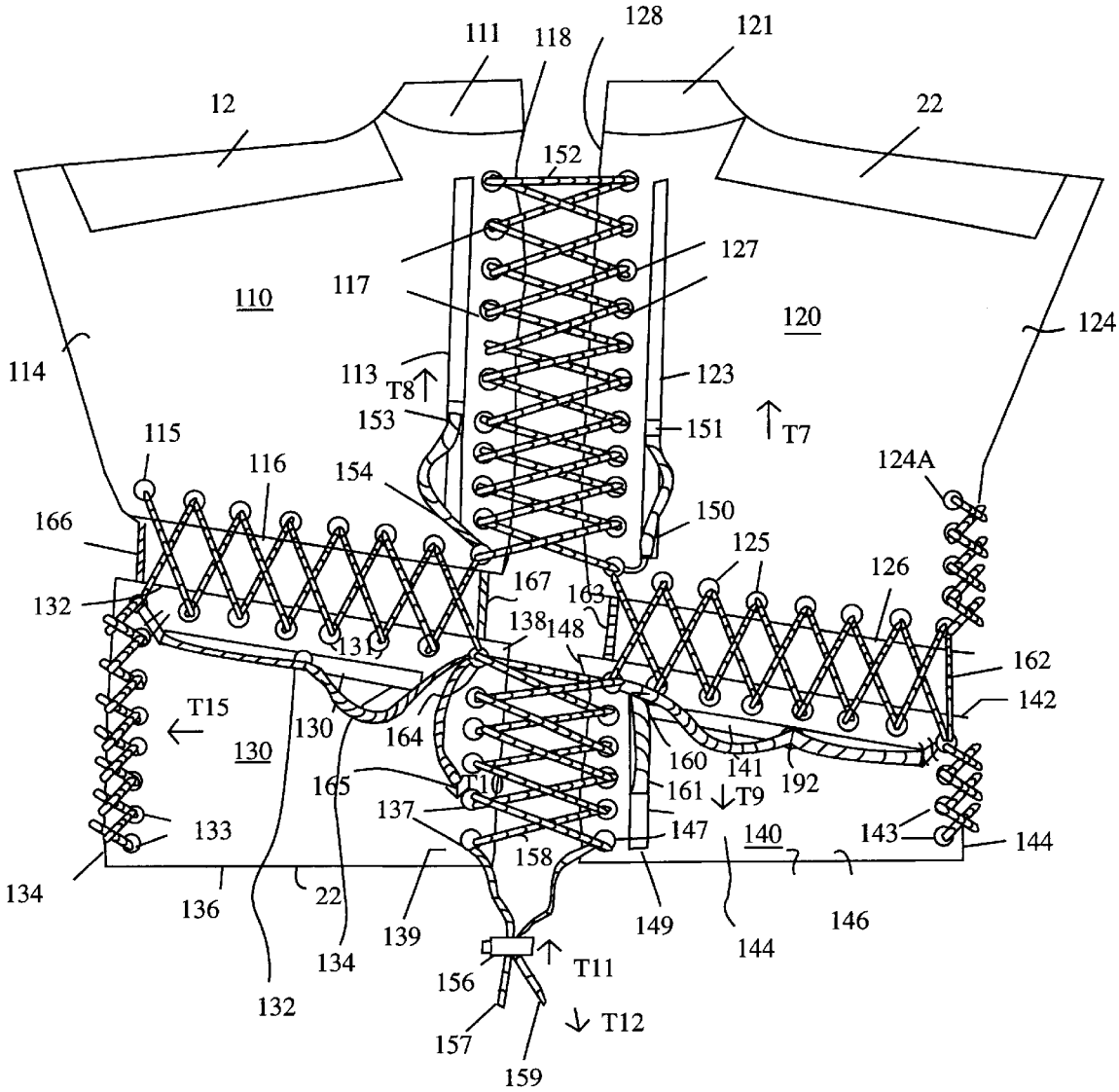
FIG. 3 is a rear view of the shirt of FIG. 2.

FIG. 3 is a rear view of the shirt of FIG. 2. Referring to FIG. 3, left rear quarter panel 110 covers a rear left back portion of a wearer and has an upper end left shoulder cover 12, that covers the left shoulder of the wearer and is fixably or removably attached thereon by being sewn, hook and loop fasteners, and the like. A left collar band portion 111 is attached for fitting about the left neck portion of the wearer. One vertical side edge 114 can angle slightly inwardly running from the edge of the shoulder downward. The opposite vertical side edge 118 can run perpendicular to the shoulders of the wearer. Along the vertical side edge 118 can be a row of lace holes 117. The bottom edge 116 can be substantially horizontal with a slight upwardly angled lower edge. Across the bottom edge 116 is a row of lace holes 115. A vertical tension adjustment strip 113 runs along vertical inner edge 118 that can be a sewn on rectangular patch with exposed hook and loop fasteners.

Right rear quarter panel 120 covers a rear right back portion of a wearer and has an upper end right shoulder cover 22, that covers the right shoulder of the wearer and is fixably or removably attached thereon by being sewn, hook and loop fasteners, and the like. A right collar band portion 121 is attached for fitting about the right neck portion of the wearer. One vertical side edge 124 can angle slightly inwardly running downward from the edge of the shoulder, with a bottom straight edge having a small row of lace holes 124A. The opposite vertical side edge 128 can run perpendicular to the shoulders of the wearer. Along the vertical side edge 128 can be a row of lace holes 127. The bottom edge 126 can be substantially horizontal with a slight upwardly angled lower edge. Across the bottom edge 126 is a row of lace holes 125. A vertical tension adjustment strip 123 can be located along vertical inner edge 128 and can be a sewn on rectangular patch with exposed hook and loop fasteners.

Referring to FIG. 3, inner side edge 118 of left panel 110 can be joined to inner side edge 128 of right panel 120 by a single tie lace 152 criss-crossing back and forth between rows of lace holes 117 and 127. Exposed end 151 of lace 152 can pass through a fixed loop 150 located on one end of rectangular patch 123. End 151 can include an end having hook and loop fasteners thereon for being removably fastened to various positions along hook and loop rectangular fastener patch 123. The further along tie end 151 is moved in the direction of arrow T7, the smaller the space exists between the side panel edges 118, 128. Likewise opposite exposed tie lace end 153 passes through a fixed loop 154 located on one end of rectangular patch 113. End 153 can include an end having hook and loop fasteners thereon for being removably fastened to various positions along hook and loop rectangular patch 113. The further along tie end 153 is moved in the direction of arrow T8, the smaller the space exists between side panel edges 118, 128.

Referring to FIG. 3, lower left rear panel 130 can include an downwardly sloped angled edge 132 having a row of lace holes 131. Outer vertical edge 134 can also include a row of lace holes 133. An opposite inner vertical edge 138 can include a row lace holes 137, and a rectangular hook and loop fastener patch 139 along the row of lace holes 137. A bottom horizontal edge 136 can run between inner and outer vertical side edges 134, 138.

Lower right rear panel 140 can include an downwardly sloped angled edge 142 having a row of lace holes 141. Outer vertical edge 144 can also include a row of lace holes 143. An opposite inner vertical edge 148 can include a row lace holes 147, and a rectangular hook and loop fastener patch 149 along the row of lace holes 147. A bottom horizontal edge 146 can run between inner and outer vertical side edges 144, 148.

Referring to FIG. 3, the bottom edge 126 of right upper panel 120 can be joined to upper edge 142 of lower right panel 140 by a single tie lace 162 having an end 161 which passes through and criss-crosses back and forth between rows of lace holes 125 and 141. Exposed end 161 of tie 162 can have a hook and loop fastener end which fastens onto hook and loop rectangular fastener patch 149. Moving end 161 through fixed loop 160 located on one end of patch 149 in the direction of arrow T9 adjusts the space between edges 126 and 142. The end of lace 163 is extended to the lower panel through loop 194 and is attached to hook and loop base 190.

Referring to FIG. 3, the bottom edge 116 of left upper panel 110 can be joined to upper edge 132 of lower left panel 130 by a single tie lace 166 having an end 165 which passes through and criss-crosses back and forth between rows of lace holes 115 and 131. Exposed end 165 of tie 166 can have a hook and loop fastener end which fastens onto hook and loop rectangular fastener patch 139. Moving end 165 through fixed loop 164 located on one end of patch 139 in the direction of arrow T10 adjusts the space between edges 126 and 142. The end of lace 167 is extended to the lower panel through loop 184 and is attached to hook and loop base 180.

Referring to FIG. 3, inner side edges 138 and 148 are joined by a single tie lace 158 having respective ends 157, 159 which pass through and criss-cross back and forth through rows of lace holes 137 and 147. A screwable tension clip 156 can be moved upward in the direction of arrow T4, while tie ends 157, 159 are moved downward in the direction of arrow T3. Moving the clip and tie ends in opposite directions allows for the space between inner side edges 138, 148 to be adjusted. Component 180 refers to the hook and loop base 180, tie lace end 182 has hook and loop fasteners such as 540 shown in FIGS. 5A–5B. Component 184 refers to a loop that can be made of fabric that can be sewn on the hook and loop base 180. Component 190 refers to a hook and loop base, and 192 can be the hook and loop fasteners 540 shown in FIGS. 5A–5B. Component 194 refers to a loop that can be made of fabric that is sewn onto the hook and loop base 190.

Figure 4:
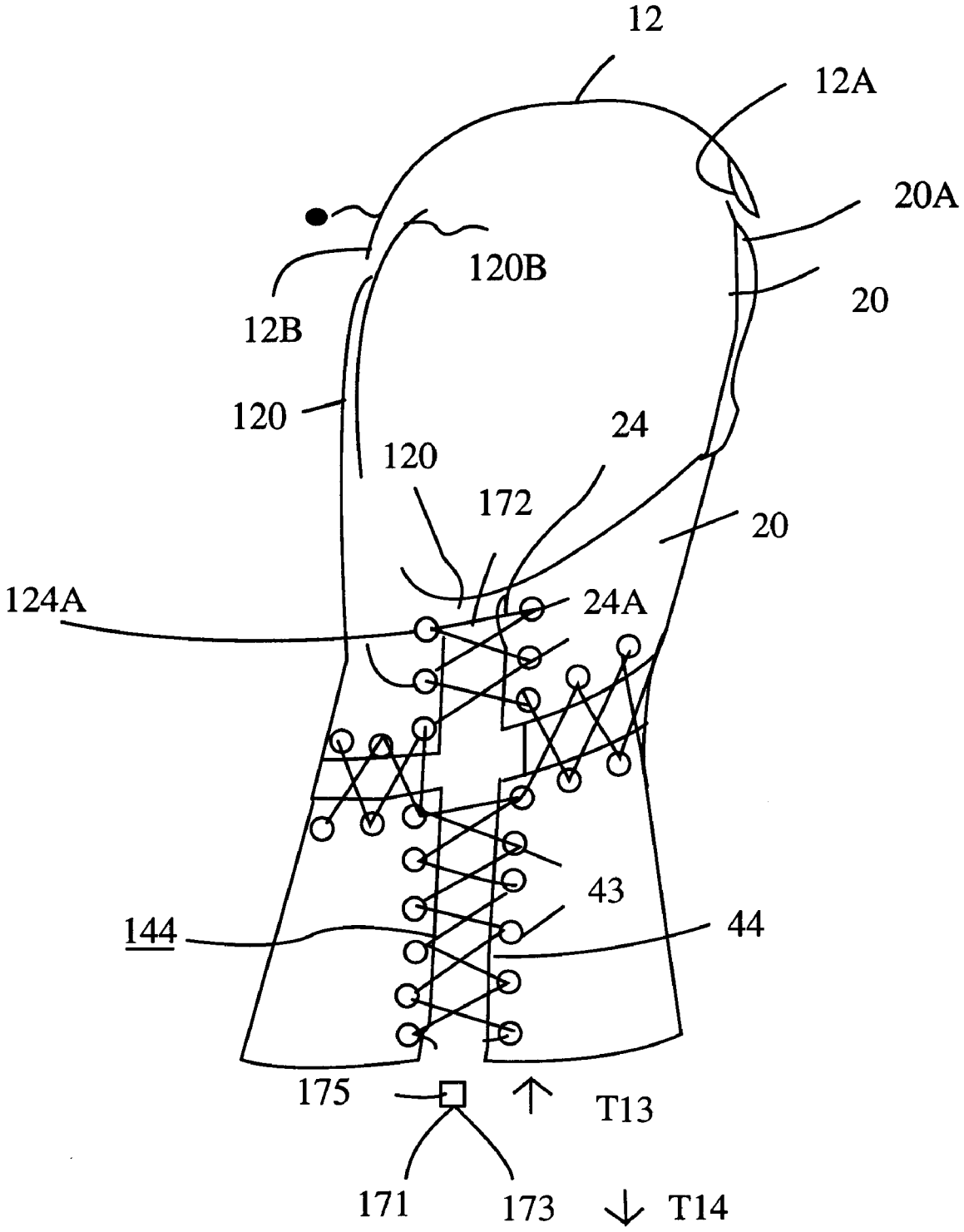
FIG. 4 is a side view of the shirt of FIG. 2 along arrow A.

FIG. 4 is a side view of the shirt of FIG. 2 along arrow A. Referring to FIG. 4, left front panel 20 can have an upper outer edge 20A having hook and loop fasteners, shoulder cover 12 can have inner edges 12A, 12B, each having hook and loop fasteners, and rear back panel 120 can have an upper exterior edge 120B having hook and loop fasteners. Edges 20, 20A, 12A, 12B, 120, 120A can have various amounts of hook and loop fastener surfaces that would allow the shoulder cover 12 to fit over various sized shoulders of the wearer.

Referring to FIG. 4, side edges 24 & 124, 44 & 144 are joined by a single tie lace 172 having respective ends 171, 173 which pass through and criss-cross back and forth through rows of lace holes 24A, 124A, 44, 144. A screwable tension clip 175 can be moved upward in the direction of arrow T13, while tie ends 171, 173 are moved downward in the direction of arrow T14. Moving the clip and tie ends in opposite directions allows for the space between inner side edges 24 & 124, 44 & 144 to be adjusted.

Figure 5A:
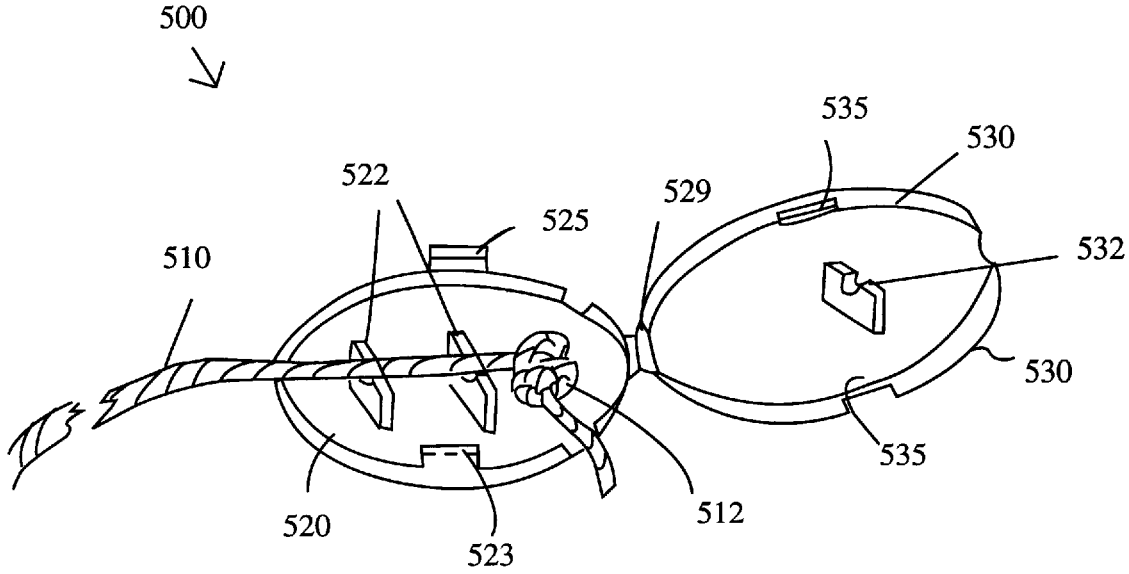
FIG. 5A shows a case for holding the lace string ends of FIGS. 2–4 in an open position.
Figure 5B:
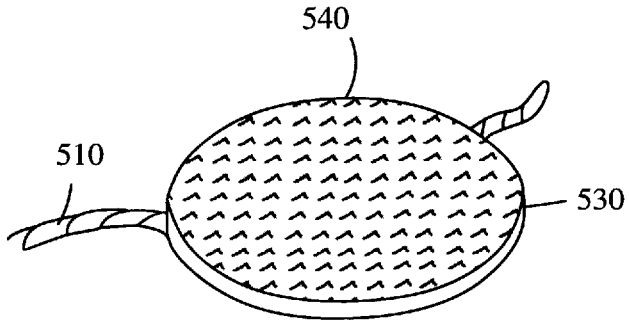
FIG. 5B shows the case of FIG. 5A in a closed position with pad of hook & loop fasteners.

FIG. 5A shows a case 500 for holding the lace string ends of FIGS. 2–4 in an open position. FIG. 5B shows the case 500 of FIG. 5A in a closed position with pad of hook & loop fasteners. Referring to FIGS. 5A–5B, case 500 includes a lower half section 520 and an upper half section 530. Lower half section 520 has interior arched supports 522 for supporting a portion 510 of a tie lace, with a knot end 512 to one side. Inwardly bending snaps 525 project from lower half section 520. Upper half section 530 includes at least one interior arched support 532 that is located to be between supports 522. Upper half section 530 is hingedly attached to lower half section 520 by hinge member 529. Side indentations 535 in upper half section 530 allow protruding snaps 525 to close locking the tied end 512 of tie lace 510. The exposed outer surface of either or both lower half section 520 or upper half section 530 can have hook and loop fasteners 540 on the surface. Case 500 allows for the exposed ends of the previously described lace ties to be have fastener surfaces thereon. The case 500 can be made from pre-injection formed plastic, and the like.

Figure 6:
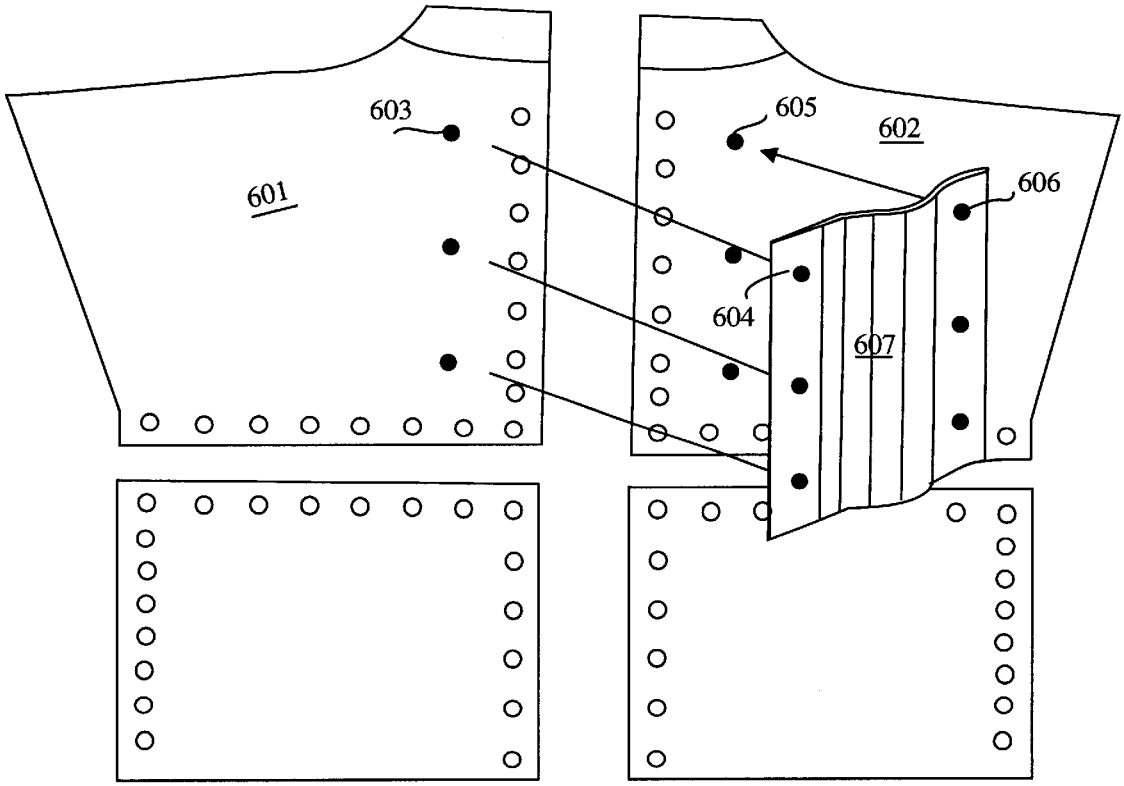
FIG. 6 shows an inside view of an expansion panel attachment for the garment shirt.

FIG. 6 shows an inside view of an expansion panel 607 and attachment fasteners 603–606 for the garment shirt panels 601, 602. The chest panel 607 can be made from a stretchable elastic fabric, and the like. The chest panel 607 can be attached to the backside of the front upper left panel 601 and upper right panel 602 by fasteners such as but not limited to parallel rows of snap button fasteners 603, 604, 605, and 606. Another type of fasteners that can be used can be hook and loop fasteners, and the like. The chest panel 607 can be stretched according the body size. Alternatively, the chest panel 607 can be removed from the garment. Although not shown, other like expansion panels and like fasteners can be used behind other tie string areas wherever, bare skin or undergarments are exposed.

The panels and materials for forming the garment shirt can be made from cotton, cotton blend, polyester, combinations thereof, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A garment shirt that can be adjustably sized to fit different body types, comprising in combination:

a left panel for covering a left front portion, left rear portion and left shoulder portion;

a right panel for covering a right front portion, right rear portion and a right shoulder portion;

a tie string for interlocking the left panel to the right panel, the tie string having at least one exposed end;

a case for wrapping about the exposed end of the tie string and having a first fastener on at least one surface of the case; and means for fastening the first fastener to different locations on the garment, wherein the fastening means adjusts tension on the exposed end of the fastener.

2. The garment shirt of claim 1, wherein the left panel and the right panel each include:

a row of lace holes along outer edges, wherein the tie string crosses back and forth between opposing rows of lace holes.

3. The garment shirt of claim 1, further comprising:

means for adjusting tension on exposed ends of the tie string.

4. The garment shirt of claim 3, wherein the tension adjusting means includes:

means for fastening the ends of the tie string to different locations on the garment, so that each of the different positions corresponds to a different amount of space between edges on the left panel and the right panel.

5. The garment shirt of claim 4, wherein the fastening means includes:

a rectangular patch having hook and loop fasteners, and the exposed ends of the tie strings includes hook and loop fasteners.

6. The garment shirt of claim 1, wherein both the left panel and the right panel each include:

an upper panel and a lower panel.

7. The garment shirt of claim 6, wherein the upper left panel, the lower left panel, the upper right panel, and the lower right panel each include:

a row of lace holes along outer edges, wherein tie strings cross back and forth between opposing rows of lace holes.

8. The garment shirt of claim 1, wherein the fastening means includes:

a rectangular patch having hook and loop fasteners, and the exposed ends of the tie strings includes hook and loop fasteners.

9. The garment shirt of claim 1, wherein the fastening means and the first fastener includes:

hook and loop fasteners on the at least one surface of the case; and a hook and loop fastener patch on the garment.

10. The garment shirt of claim 9, wherein the case includes:

a top portion that locks an exposed end of the tie strings to a lower portion.

11. The garment shirt of claim 1, further comprising:

a center panel attached between the left panel and the right panel for covering a chest region behind the tie string.

12. The garment shirt of claim 11, further comprising:

means for removably fastening the center panel to the left panel and to the right panel.

13. The garment shirt of claim 12, wherein the fastening means includes:

snaps.

14. A garment shirt that can be adjustably sized to fit different body types, comprising in combination:

a left front panel for covering a left front portion;

a left rear panel for covering a left rear portion;

a right front panel for covering a right front portion;

a right rear panel for covering a right rear portion;

a first tie string for interlocking the left front panel to the right front panel;

a second tie string for interlocking at least one of: a left edge of the left front panel to a left edge the left rear panel, and a right edge of the right front panel to a right edge of the right rear panel; and a case for wrapping about an exposed end of at least one of the first tie string and the second tie string, and having a first fastener on at least one surface of the case; and means for fastening the first fastener to different locations on the garment, wherein the fastening means adjusts tension on the at least one exposed end of the first tie string and the second tie string.

15. The garment shirt of claim 14, further comprising:

a left shoulder portion; and a right shoulder portion, wherein the second tie string interlocks the left front panel to the left rear panel beneath the left shoulder portion.

16. The garment shirt of claim 14, further comprising:

a left shoulder portion; and a right shoulder portion, wherein the second tie string interlocks the right front panel to the right rear panel beneath the right shoulder portion.

17. The garment shirt of claim 14, further comprising:

a third tie string;

a left shoulder portion; and a right shoulder portion, wherein the second tie string interlocks the right front panel to the right rear panel beneath the right shoulder portion, and the third tie string interlocks the left front panel to the left rear panel beneath the left shoulder portion.

18. A garment shirt that can be adjustably sized to fit different body types, comprising in combination:

a left front panel for covering a left front portion, the left front panel having an upper edge, a left edge, and a right edge;

a rear panel for covering a rear portion, the rear panel having an upper edge, a left edge, and a right edge;

left means for attaching the upper edge of the left front panel to the upper edge of the rear panel;

a right front panel for covering a right front portion, the right front panel having an upper edge, a left edge, and a right edge;

right means for attaching the upper edge of the right front panel to the upper edge of the rear panel;

a first tie string for interlocking the right edge of the left front panel to the left edge of the right front panel;

a second tie string for interlocking at least one of: the left edge of the left front panel to the left edge of the rear panel, and the right edge of the right front panel to the right edge of the rear panel; and a case for wrapping about an exposed end of at least one of the first tie string and the second tie string, and having a first fastener on at least one surface of the case; and means for fastening the first fastener to different locations on the garment, wherein the fastening means adjusts tension on the at least one exposed end of the first tie string and the second tie string.

* * * * *